US007481233B2

(12) United States Patent
Park

(10) Patent No.: US 7,481,233 B2
(45) Date of Patent: Jan. 27, 2009

(54) CUSTOM FITTED CRUTCH WITH TWO SHOCK-ABSORBERS

(76) Inventor: Dae Shik Park, 2821 Norsewood Dr., Rowland Heights, CA (US) 91748

( * ) Notice: Subject to any disclaimer, the term of this patent is extended or adjusted under 35 U.S.C. 154(b) by 0 days.

(21) Appl. No.: 11/585,035

(22) Filed: Oct. 23, 2006

(65) Prior Publication Data

US 2007/0089770 A1 Apr. 26, 2007

(51) Int. Cl.
*A61H 3/021* (2006.01)

(52) U.S. Cl. ..... 135/82; 135/69; 135/73; 135/86

(58) Field of Classification Search ..... 135/65, 135/68–70, 77, 82–84, 86, 71, 73; 280/823
See application file for complete search history.

(56) References Cited

U.S. PATENT DOCUMENTS 1,336,844 A * 4/1920 Klousnitzer ..... 135/82
1,406,453 A * 2/1922 Fanning ..... 135/82
2,397,499 A * 4/1946 McGowan ..... 135/82
2,398,534 A * 4/1946 Klausnitzer et al. ..... 135/82
2,856,943 A * 10/1958 Sparlin ..... 135/68
2,888,022 A * 5/1959 Fanning ..... 135/82
5,720,474 A * 2/1998 Sugiyama ..... 267/249
6,055,998 A * 5/2000 Bader ..... 135/69
6,186,487 B1 * 2/2001 Kesinger ..... 267/249
6,286,529 B1 * 9/2001 Olivera ..... 135/82
7,025,072 B2 * 4/2006 McGrath ..... 135/75
2002/0170587 A1 * 11/2002 Uemura ..... 135/65

* cited by examiner

*Primary Examiner*—Winnie Yip

(57) ABSTRACT

A crutch equipped with double shock absorbers is provided. The crutch of the current invention has an air shock absorber vertically combined with a spring shock absorber in one base shaft. A rubber shoe receives bottom of the spring shock absorber. The crutch of the current invention absorbs the shock of stepping ground firstly with the spring shock absorber and then reduces the impact with the air shock absorber. The double shock absorbing mechanism provides a smooth feeling of stepping the ground to a user. The strength of the resilient force of the crutch can be adjusted for each user, based on weight of a user, by medical doctor's characterization.

1 Claim, 4 Drawing Sheets

CUSTOM FITTED CRUTCH WITH TWO SHOCK-ABSORBERS

1. FIELD OF THE INVENTION

The present invention relates to a shock absorbing crutch, particularly a crutch equipped with an air shock absorber vertically combined with a spring shock absorber.

2. BACKGROUND OF THE INVENTION

Crutches and similar devices are commonly used to assist patients and disabled personnel with mobility. Most of them have solid structure to support the weight of user. Consistent use of such solid devices can cause many types of injuries, for example, injuries to cartilage, tendons, and joints of the wrist, forearm, shoulder, and soft tissue damage to underarm areas. However, inconvenience of using such solid device burdens users most. Some of prior art devices utilize various kinds of springs when trying to mitigate the impact of the crutch with the ground. Although the use of a spring is somewhat successful, some problems still exists. For example, bouncing or skipping on hard surfaces when striking the ground at an incident angle, it can cause traction problems. Therefore, there still exists a need for a crutch device that provides more improved impact mitigating system during the use of crutches, while also helping to protect against possible traction problems. In addition to this, many disabled person needs more personally customized crutch for themselves. It is the purpose of the current application to provide a crutch to meet such needs.

DESCRIPTION OF THE PRIOR ARTS

U. S. Patent Application Publication 20050129456 to Van Der Sluis, illustrates an improved crutch device generally includes a gel shock, a fixed tube assembly, and a sliding tube assembly. The present invention is configured to facilitate dampening the impact and preventing or mitigating injuries at least partially caused by the use of a device, wherein the device (e.g., crutch) provides support or assists movement, such as, for example, canes, crutches and forearm crutches.

U. S. Patent Application Publication 20050076941 to Larson, Brad illustrates an ergonomic collapsible crutch for providing assistance with ambulatory movement of a user, the crutch including a supporting member having an underarm support surface and a hand grip portion, a gripping pad disposed remotely from the under arm support surface generally along a vertical axis and connected to the supporting member to provide stability and grip on surfaces of a walking environment, and a hand grip attached to the hand grip portion of the supporting member so that the handgrip extends from the supporting member at an angle from the vertical axis ranging from about 85.degree. to about 60.degree. and from about 95.degree. to about 120.degree. The ergonomic collapsible crutch may also include a shock absorbing device and buttons for adjusting the height of the crutch as well as the position of the hand grip. The hand grip may also be ergonomically contoured for improved use by a user.

U. S. Patent Application Publication 20020144723 to Zulla, Anthony John, et al., illustrates a pair of crutches of walker type, each being made with a moveable, spring-loaded shoulder support. The shoulder support incorporates an eye bolt that pivots at its center axis from the shoulder support, then down through a flat stock steel spring. It follows through a cross member which secures both sides of the crutch. The spring action at the shoulder support acts as a cushion when the individual's body weight is shifted. This creates a forward, and rear movement, with each stride. This pivoting, spring action provides the user with comfort and less pressure and shock under the arm pit area.

U.S. Pat. No. 5,628,335 to Free illustrates a shock absorbing crutch includes two support shafts having an upper end, a lower end, and a plurality of apertures, an arm rest including two bores positioned on the upper ends of each support rod, two screws being positioned through the bores to secure the arm rest in place, a hand grip being positioned between the support shafts and including an axial aperture extending there through, a bolt being positioned through the apertures in the support bars and hand grip; two stabilizing shafts each having a lower end and an upper end being positioned within the lower end of the support shaft, an extension tab being affixed to the upper end of the stabilizing shaft and positioned within an aperture of the support shaft; a shock absorber with an upper section including a spring and a lower section, the lower section being positioned within the upper section, a mounting plate coupling the shock absorber to the stabilizing shafts; and a lower shaft being positioned within the upper shaft and secured in place by the extension tab, a user positioning the hand grip and shafts at an appropriate height and securing the shafts with the extension tabs.

U.S. Pat. No. 4,476,885 to Stein, U.S. Pat. No. 5,411,045 to Davis, U.S. Pat. No. 5,445,175 to Cho, U.S. Pat. No. 4,625,743 to Harker, U.S. Pat. No. Des. 318,366 to Goldstein et al., U.S. Pat. No. Des. 322,713 to Daniels disclose various crutches. However, none of these prior art illustrates a comfortable to use crutches as shown in the current invention.

SUMMARY OF THE INVENTION

Crutches and similar devices are commonly used to assist patients and disabled personnel with mobility. Most of them have solid structure to support the weight of user. Consistent use of such solid devices can cause many types of injuries, for example, injuries to cartilage, tendons, and joints of the wrist, forearm, shoulder, and soft tissue damage to underarm areas. However, inconvenience of using such solid device burdens users most. Some of prior art devices utilize various kinds of springs when trying to mitigate the impact of the crutch with the ground. Although the use of a spring is somewhat successful, some problems still exists. For example, bouncing or skipping on hard surfaces when striking the ground at an incident angle, it can cause traction problems. Therefore, there still exists a need for a crutch device that provides more improved impact mitigating system during the use of crutches, while also helping to protect against possible traction problems. To attain this, a crutch equipped with two shock absorbers is provided. The crutch of the current invention has an air shock absorber vertically combined with a spring shock absorber in one base shaft. A rubber shoe receives bottom of the spring shock absorber. The crutch of the current invention absorbs the shock of stepping ground firstly with the spring shock absorber and then further reduces the impact with the air shock absorber. The double shock absorbing mechanism provide with a smooth feeling of stepping the ground to the user. Therefore a patient or a disabled person can use it without pain to step on the ground. Strengths of the resilient force of the crutch can be adjusted for each user by adjusting the air pressure of the air shock absorber and by changing specification of the spring shock absorber according to use's body weight and physical conditions characterized by a medical doctor.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENT

Figure 1:
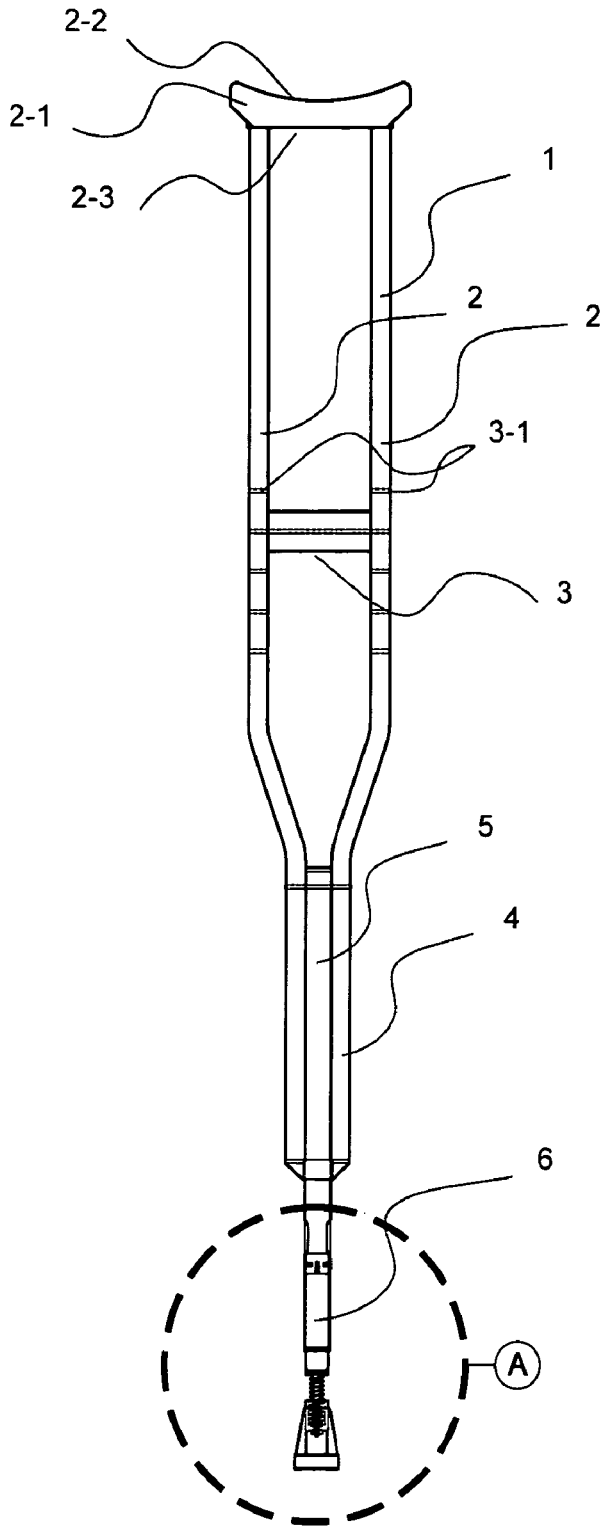
FIG. 1 is a side perspective view of the preferred embodiment of a double shock absorbing crutch constructed in accordance with the principles of the present invention.

A crutch equipped with two shock absorbers is provided. The crutch of the current invention has an air shock absorber vertically combined with a spring shock absorber in one base shaft. FIG. 1 is a side perspective view of the preferred embodiment of a double shock absorbing crutch (1) constructed in accordance with the principles of the present invention.

Upper shaft (2) of the crutch (1) of the current invention is made of two aluminum tubes. Hand grip (3) of the crutch (1) of the current invention is made as adjustable like many other conventional crutches. Medium shaft (4) of the crutch (1) of the current invention is comprised of one aluminum tube (5) that constitutes a leg part and the two aluminum tubes (2-4), that are extended from the upper shaft (2), combined together. An armrest (2-1) is fabricated with elastomeric material, the arm rest (2-1) having an indented upper surface (2-2) and a linear lower surface (2-3). A hand grip (3) fabricated of elastomeric material and including an axial aperture extending there through. The hand grip being positioned between the two aluminum tubes (2-4). Vertical position of the hand grip (3) is adjusted by engaging the hand grip (3) to one pair of the matching holes (3-1) that are developed on the two aluminum tubes (2-4) at the same vertical level.

Figure 2:
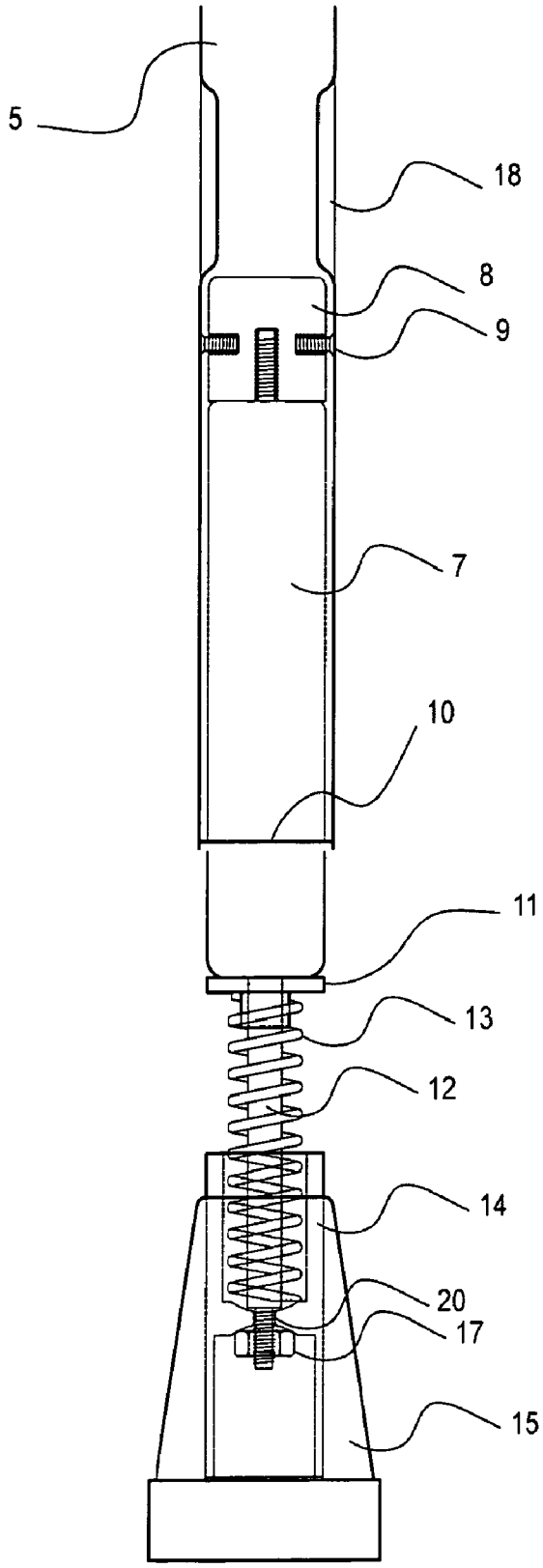
FIG. 2 is an enlarged side cross sectional view of part 'A' in FIG. 1.

FIG. 2 is an enlarged side cross sectional view of part 'A' in FIG. 1. The base shaft (6) of the crutch of the current invention is comprised of an air shock absorber (7), a screw pitched top holder (8) of the air shock absorber (7), a straight aluminum tube (5) that extended from the medium shaft (4), three screws (9), an aluminum washer (10), an aluminum spacer (11), an aluminum rod (12), a metal spring (13) engaged to the aluminum rod (12), an aluminum casing (14) that receives the spring (13) and the aluminum rod (12) at the bottom side, and a rubber shoe (15) that covers the aluminum casing (14). The aluminum rod (12) is fixed to the air shock absorber (7) via welding and fixed to the aluminum casing (14) via a nut (17).

Figure 3:
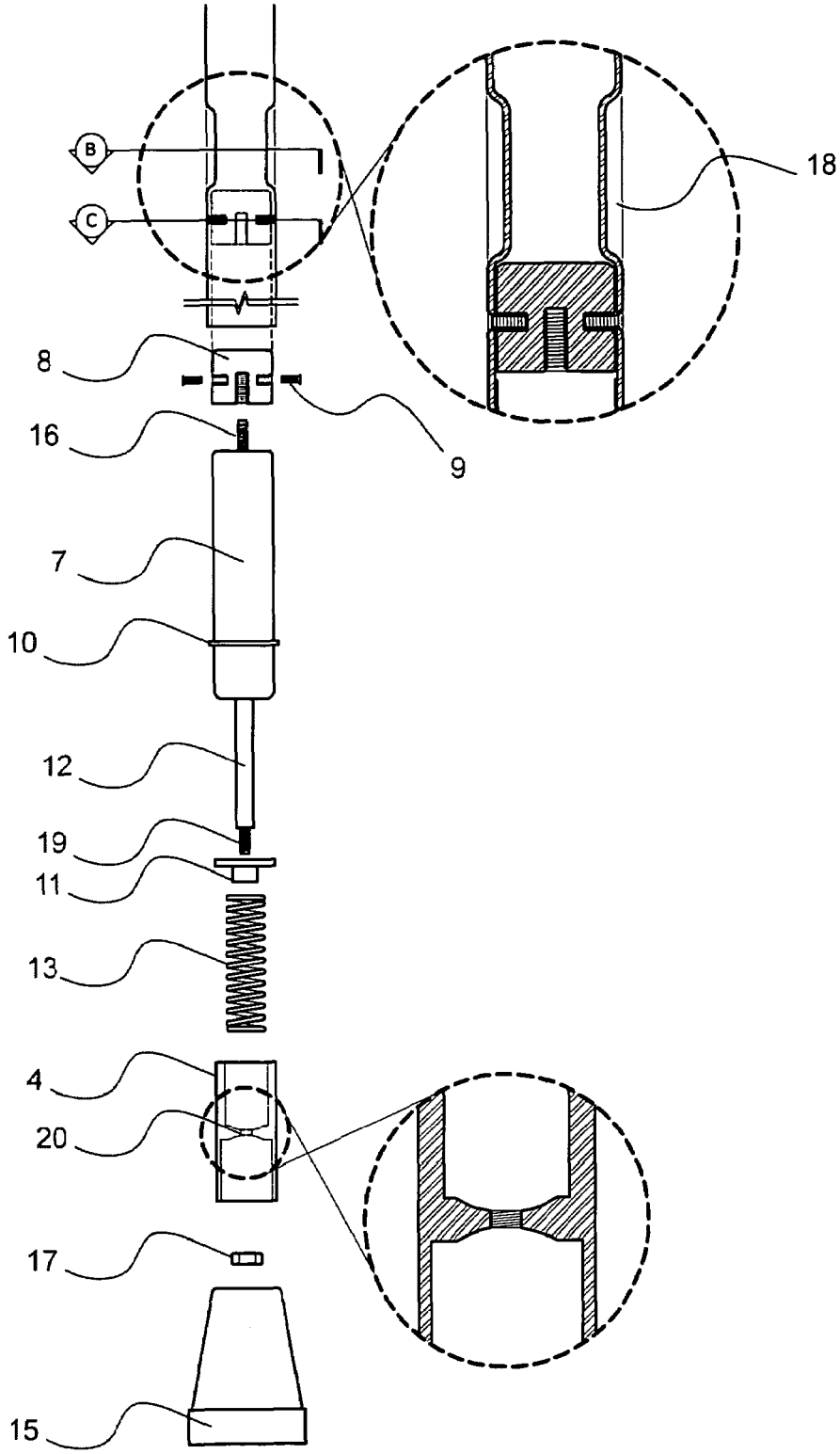
FIG. 3 is an exploded cross sectional view of the part 'A' in FIG. 1.
Figure 5:
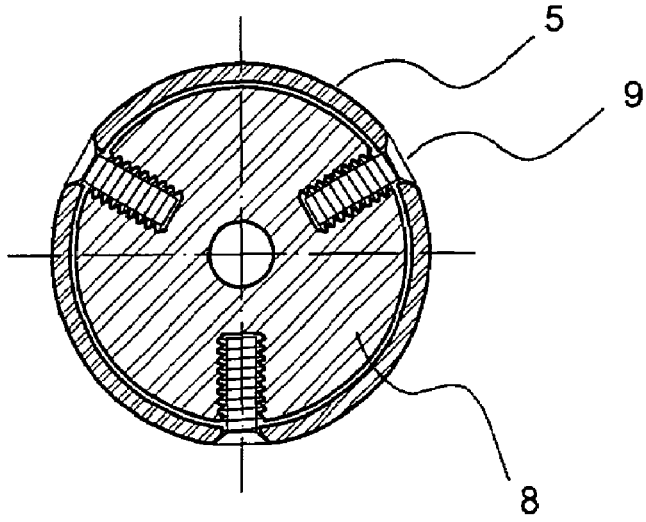
FIG. 5 is a cross sectional over view of a screw pitched top holder, marked as 'C' in FIG. 3.

FIG. 3 is an exploded cross sectional view of the part 'A' in FIG. 1. The aluminum tube (5), which is extended from the medium shaft (4), has three indented bumps (18) for blocking the screw pitched top holder (8) and the air shock absorber (7) inside thereof. Three female threads (8-1) are developed on the pitched top holder (8) along the side thereof to receive the three screws (9) as shown in FIG. 5 The three screws (9) that are engaged to the three female threads (8-1) fix the screw pitched top holder (8) in the aluminum tube (5) under the three indented bumps (18). A screw (16) is welded to the upper surface of the air shock absorber (7) and an aluminum rod (12), whose lower end is screw (19), is welded to the bottom surface of the air shock absorber (7).

Upper end of the air shock absorber (7) is engaged to the screw pitched top holder (8) via the screw (16). The aluminum washer (10) is engaged to the gas absorber (7) on the lower medium part thereof to prevent the air shock absorber (7) from sticking into the aluminum tube (5). The aluminum spacer (11) protects the lower surface of the air shock absorber (7) from contacting with the metal spring (13) at the lower part thereof to prevent wear out or puncture of the air shock absorber (7). The metal spring (13) is engaged on the aluminum rod (12), whose lower end is screw (19) and upper end is welded to the bottom surface of the air shock absorber (7). Lower end of the aluminum rod (12), the screw (19) is engaged to the screw pitch (20) of the aluminum casing and fastened via a nut (17). The aluminum casing (14) is tightly inserted to the rubber shoe (15).

Figure 4:
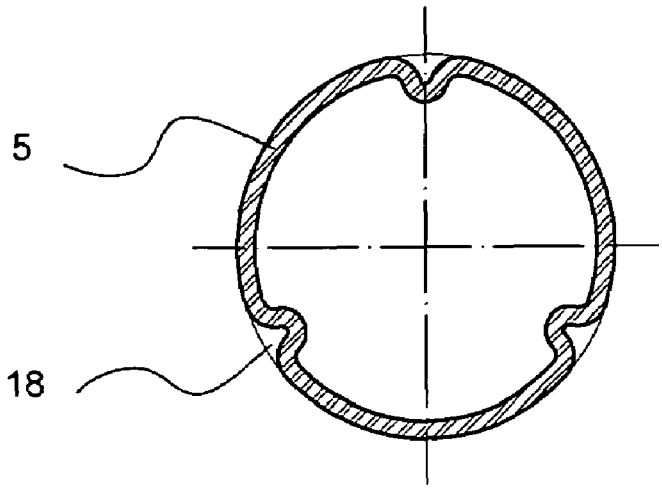
FIG. 4 is a cross sectional over view of an indented portion of an aluminum tube, marked as 'B' in FIG. 3.

FIG. 4 is a cross sectional over view of an indented portion of an aluminum tube (5), marked as 'B' in FIG. 3. These indented bumps (18) prevent the screw pitched top holder (8) from sticking into the aluminum tube (5) when the screws (9) are disengaged from the female threads (8-1). FIG. 5 is a cross sectional over view of a screw pitched top holder (8), marked as 'C' in FIG. 3. The three screws (9) are engaged to the three female threads (8-1) to hold the screw pitched top holder (8) to the aluminum tube (5).

Actually, there are three kinds of shock absorbing systems in the current invention. First is the rubber shoe (15). Second is the metal spring (13). It is a kind of mechanical shock absorber. Third is the air shock absorber (7). It reduces the stepping shock and releases the immediate shock to a controllable shock. Strengths of the resilient force of the crutch can be adjusted for each user by adjusting the air pressure of the air shock absorber and by changing specification of the spring shock absorber according to use's body weight and physical conditions characterized by a medical doctor.

What is claimed as being new and desired to be protected by Letters Patent of the United States is as follows:

1. A two shock absorbers equipped crutch which is comprised of:

one upper shaft that is made of two separated aluminum tubes, and an arm rest fabricated of elastomeric material and having an indented upper surface and a linear lower surface, and a hand grip that is fabricated of elastomeric material and includes an axial aperture extending there through and is positioned between the two aluminum tubes and a vertical position of which is adjusted by engaging to one pair of the matching holes that are developed on the two aluminum tubes at the same vertical level, and a medium shaft, which is comprised of one aluminum tube that constitutes a leg part and the two aluminum tubes that are extended from the upper shaft, combined together, and a straight aluminum tube that is extended from the medium shaft, and an air shock absorber that is mounted in the straight aluminum tube, and a screw pitch top holder of the air shock absorber that receives an upper end of the air shock absorber and fixes the upper end of the air shock absorber via a screw, and the screw that is welded to the upper surface of the air shock absorber, and straight aluminum tube that has three indented bumps for blocking the screw pitched top holder and the air shock absorber inside thereof, and three screws that fix the screw pitched top holder in the straight aluminum tube under the three indented bumps, and an aluminum washer that is engaged to the air shock absorber on a lower medium part thereof to prevent the air shock absorber from sticking into the straight aluminum tube, and an aluminum rod that is welded to the bottom surface of the air shock absorber and extends downward therefrom, and a metal spring engaged to the aluminum rod, and an aluminum spacer that protects the lower surface of the air shock absorber from contacting with the metal spring at the lower part thereof to prevent wear out or puncture of the air shock absorber, and an aluminum casing that receives the spring and fixed to the aluminum rod at the bottom side, and a rubber shoe that covers the aluminum casing.

* * * * *